US010233650B2

(12) United States Patent
Fiser

(10) Patent No.: US 10,233,650 B2
(45) Date of Patent: Mar. 19, 2019

(54) ROOF VENT

(71) Applicant: Lomanco, Inc., Jacksonville, AR (US)

(72) Inventor: Jakob D Fiser, Jacksonville, AR (US)

(73) Assignee: Lomanco, Inc., Jacksonville, AR (US)

( * ) Notice: Subject to any disclaimer, the term of this patent is extended or adjusted under 35 U.S.C. 154(b) by 847 days.

(21) Appl. No.: 14/594,530

(22) Filed: Jan. 12, 2015

(65) Prior Publication Data

US 2016/0201332 A1 Jul. 14, 2016

(51) Int. Cl.
*F24F 7/02* (2006.01)
*E04D 13/17* (2006.01)

(52) U.S. Cl.
CPC ..... *E04D 13/174* (2013.01); *F24F 7/02* (2013.01)

(58) Field of Classification Search
USPC ..... 454/365
See application file for complete search history.

(56) References Cited

U.S. PATENT DOCUMENTS

| | | | |
|---|---|---|---|
| 2,300,842 | A | 11/1942 | Leslie |
| 2,447,472 | A | 8/1948 | Donley |
| 2,490,220 | A | 12/1949 | Leslie |
| 2,551,223 | A | 5/1951 | Schneider |
| 2,551,965 | A | 5/1951 | Petersen et al. |
| 2,636,429 | A | 4/1953 | Parsons |
| 2,692,548 | A | 10/1954 | Knorr |
| 3,073,235 | A | 1/1963 | Randall et al. |
| 3,094,915 | A | 6/1963 | Leigh |
| D203,484 | S | 1/1966 | Rousey et al. |
| 3,524,400 | A | 8/1970 | Magi |
| 3,625,134 | A | 12/1971 | Smith |
| 4,000,688 | A | 1/1977 | Kersteter |
| 4,109,433 | A | 8/1978 | Maze |
| D256,047 | S | 7/1980 | Wormington |
| 4,212,692 | A | 7/1980 | Rasen et al. |
| 4,214,510 | A | 7/1980 | Ward |
| 4,252,590 | A | 2/1981 | Rasen et al. |
| 4,315,392 | A | 2/1982 | Sylvest |
| 4,325,290 | A | 4/1982 | Wolfert |
| 4,393,634 | A | 7/1983 | McDermott et al. |
| RE31,599 | E | 6/1984 | Rasen et al. |

(Continued)

FOREIGN PATENT DOCUMENTS

| | | | |
|---|---|---|---|
| AU | 2012200940 | A1 | 9/2013 |
| CA | 1039557 | A1 | 10/1978 |

(Continued)

OTHER PUBLICATIONS

Air Vent, Inc Air Vent Airhawk® RVA 51/RVG 51 Square Vent, 1992.

(Continued)

*Primary Examiner* — Gregory L Huson
*Assistant Examiner* — Frances F Hamilton
(74) *Attorney, Agent, or Firm* — Joe D. Calhoun

(57) ABSTRACT

A vent for a roof or other structure, comprising a cavity housing portion and an outside-housing extension portion including an extension footing extending from a lower edge of a louvered ventilation side. The extension footing includes footing sub-portions to obstruct gaps between the extension footing and the structure, such as a plurality of tabs extending from the extension footing corner-edge biasing the free edge of the tab downwardly below the extension footing.

19 Claims, 22 Drawing Sheets

(56) References Cited

U.S. PATENT DOCUMENTS 4,530,193 A 7/1985 Ochs
4,572,059 A * 2/1986 Ramsay ..... F24F 7/02 454/365
4,643,080 A 2/1987 Trostle et al.
4,689,258 A 8/1987 Slosberg et al.
4,805,367 A 2/1989 Kleckner
4,810,573 A 3/1989 Harriett
4,843,953 A 7/1989 Sells
4,852,517 A 8/1989 Smith et al.
4,903,445 A 2/1990 Mankowski
4,907,499 A 3/1990 James
4,924,761 A 5/1990 MacLeod et al.
4,942,699 A 7/1990 Spinelli
4,957,037 A * 9/1990 Tubbesing ..... E04D 13/174 454/366
4,962,692 A 10/1990 Shuert
4,996,812 A 3/1991 Venable
5,009,149 A 4/1991 MacLeod et al.
5,050,489 A 9/1991 Mankowski
5,054,377 A 10/1991 Mochel et al.
5,070,771 A * 12/1991 Mankowski ..... E04D 13/174 454/275
5,092,225 A 3/1992 Sells
5,095,810 A 3/1992 Robinson
5,099,627 A 3/1992 Coulton et al.
5,149,301 A 9/1992 Gates
5,174,076 A 12/1992 Schiedegger et al.
5,238,450 A 8/1993 Rotter
5,439,417 A 8/1995 Sells
5,458,538 A 10/1995 MacLeod et al.
5,498,204 A 3/1996 Anderson et al.
5,549,513 A 8/1996 Thomas et al.
5,573,844 A 12/1996 Donovan et al.
5,591,080 A 1/1997 Ward
5,673,521 A 10/1997 Coulton et al.
5,772,502 A * 6/1998 Smith ..... E04D 13/174 454/365
5,797,222 A 8/1998 Martin
5,946,868 A 9/1999 Morris
5,947,817 A 9/1999 Morris et al.
6,068,551 A 5/2000 Oremland
6,086,755 A 7/2000 Tepper
6,128,869 A 10/2000 Brotherton et al.
6,149,517 A * 11/2000 Hansen ..... E04D 13/174 454/365
6,202,372 B1 3/2001 Powell
6,212,833 B1 4/2001 Henderson
6,227,963 B1 * 5/2001 Headrick ..... E04D 13/174 454/365
6,233,887 B1 5/2001 Yoshioka
6,260,315 B1 * 7/2001 Smith ..... E04D 13/176 454/365
6,277,024 B1 8/2001 Coulton
D448,468 S 9/2001 Koessler
6,283,852 B1 9/2001 Igo
6,293,862 B1 9/2001 Jafine et al.
6,296,912 B1 10/2001 Zickell
6,361,434 B1 3/2002 Brandon
6,371,847 B2 * 4/2002 Headrick ..... E04D 13/174 454/365
6,418,692 B1 7/2002 Freshwater et al.
6,447,392 B1 9/2002 Henderson
6,482,084 B2 * 11/2002 Hansen ..... E04D 13/174 454/365
6,487,826 B1 12/2002 McCorsley et al.
6,491,581 B1 12/2002 Mankowski
6,599,184 B2 7/2003 Morris
6,684,581 B2 * 2/2004 Robinson ..... E04D 13/176 454/365
6,733,381 B1 5/2004 Ploeger
6,793,574 B1 9/2004 Robinson
6,881,144 B2 4/2005 Hansen et al.
D511,847 S 11/2005 Ciepliski
D511,848 S 11/2005 Ciepliski
6,991,535 B2 * 1/2006 Ciepliski ..... E04D 13/176 454/365
7,024,828 B2 4/2006 Headrick
7,179,165 B2 2/2007 Cook
7,219,473 B2 5/2007 Mantyla et al.
7,237,801 B2 7/2007 Quioc et al.
D565,719 S 4/2008 Cheng
D574,947 S 8/2008 Grisham et al.
7,556,734 B2 7/2009 Lee et al.
7,662,037 B2 * 2/2010 Polston ..... E04D 13/174 454/365
D618,780 S 6/2010 Williams, Sr.
7,766,735 B2 8/2010 Ciepliski et al.
7,814,715 B2 * 10/2010 Coulton ..... F24F 7/02 454/364
7,856,764 B2 12/2010 Kortuem et al.
8,069,621 B2 * 12/2011 Mantyla ..... E04D 13/174 454/250
8,157,628 B2 4/2012 Villela et al.
8,322,089 B2 * 12/2012 Railkar ..... E04D 13/174 52/198
8,790,167 B2 * 7/2014 Holland ..... F24F 7/02 454/242
D710,985 S 8/2014 Gassman et al.
9,175,480 B1 * 11/2015 Polston ..... E04D 13/174
9,540,823 B2 * 1/2017 Mankowski ..... E04D 13/176
2001/0019941 A1 * 9/2001 Headrick ..... E04D 13/174 454/365
2002/0016150 A1 2/2002 Hansen
2002/0078651 A1 6/2002 Freshwater et al.
2002/0100232 A1 8/2002 Robinson et al.
2004/0088928 A1 5/2004 Headrick et al.
2006/0079173 A1 4/2006 Coulton et al.
2006/0116069 A1 * 6/2006 Urbanski ..... E04D 13/174 454/365
2007/0049190 A1 3/2007 Singh
2007/0072541 A1 3/2007 Daniels et al.
2008/0287054 A1 * 11/2008 Carlson ..... E04D 13/174 454/365
2009/0113823 A1 5/2009 Osborne
2009/0233541 A1 * 9/2009 Holland ..... B29C 45/0003 454/365
2010/0112932 A1 * 5/2010 Grubka ..... E04D 13/174 454/365
2011/0195655 A1 * 8/2011 Holland ..... E04D 13/174 454/365
2014/0099877 A1 4/2014 Gassman et al.
2014/0308891 A1 * 10/2014 Holland ..... E04D 13/174 454/365

FOREIGN PATENT DOCUMENTS

CA 2067360 A1 4/1991
CA 2265384 A1 9/2000
DE 23 56 782 A1 5/1975
DE 93 08 401 U1 10/1993
DE 101 49 532 C1 3/2003
EP 0 622 500 11/1994
EP 0 622 500 A1 11/1994
GB 551198 A 2/1943
GB 552900 A 4/1943
GB 586525 A 3/1947
GB 1 583 995 A 2/1981
GB 2 083 204 3/1982
GB 2 199 860 A 7/1988
GB 2 236 775 A 4/1991
GB 2290568 7/1998
GB 2 335 666 9/1999
GB 2 345 536 A 7/2000
GB 2186898 A 7/2005
GB 2 425 319 10/2006
JP 10152957 A 6/1998
WO WO 9015959 12/1990
WO WO 2004/005825 A1 1/2004
WO WO 2007/137906 1/2008

(56) References Cited

OTHER PUBLICATIONS

Air Vent, Inc., Air Vent Airhawk® RVA 40/RVG 40 Slant Back, 1992.
Air Vent, Inc., Air Vent Airhawk® RVA 50/RVG 50 Slant Back, 1992.
Air Vent, Inc., Air Vent Airhawk® RVG 55 Slant Galvanized, 1992.
Air Vent, Inc., Air Vent Airhawk® RVG 53 Square High Collar, 1992.
Air Vent, Inc., Air Vent Airhawk® B-144 MetalDome, 1992.
Air Vent, Inc., Air Vent Shinglevent II, 1991.
Mid-America Building Products Corp., RidgeMasterTM, 1991.
Cor-A-Vent, Inc., Coravent®, 1991.
Alcoa Building Products, Rovar®, 1991.
Trimline Building Products, Off-Peak Vent Installation Instructions, www.trimline-products.com, 2006.
DCI Products, Inc., SmartVent Off-Peak Application, www.dciproducts.com, 2005.
DCI Products, Inc., SmartVent Off-Peak Application, www.dciproducts.com, 2006.
Ridgeline Incorporated, Ridgeline Ridge Vent Systems—Install a Ridgeline Ride Vent and You'll Breathe a Lot Easier, 1998.
Ridgeline Incorporated, Ridgeline Product Guide, 1998.
Air Vent, Inc., Air Vent Inc. ShingleVent II—The Balanced System for Attic Ventilation, 1992.
Air Vent, Inc., The Best Vents for All Homes, 1992.
Air Vent, Inc., Architectural Drawings and Installation Instructions, 1993.
Air Vent, Inc., External Baffles vs. Internal Baffles Shingle-Over Ridge Vent Comparison Tests, 1991.
Air Vent, Inc., The Best Vents for All Homes, 1991.
Roofing Contractor, Sell the System! "No intake vents, no system;" advertisement for SmartVent by DCI, Tapered Under—Shingle Attic Intake Ventilation, Mar. 2005.
Roofer's Exchange(Mid-Atlantic Division)Sell the System!"No intake vents, no system" advertisement for SmartVent by DCI, Tapered Under—Shingle Attic Intake Ventilation, Mar. 2005.
Roofing Contractor, Manufacturers Spotlight DCI Products Inc., Jan. 2006.
Roofing Contractor, Need Intake? Guaranteed Airflow with SmartVent; advertisement for SmartVent by DCI, Oct. 2006.
Roofing Contractor, Need Intake? Guaranteed Airflow with SmartVent; advertisement for SmartVent by DCI, Feb. 2007.
JLC, Sell the System! "No intake vents, no system;" advertisement for SmartVent by DCI, Tapered Under—Shingle Attic Intake Ventilation, Jan. 2005.
Roofing Contractor, Sell the System! "No intake vents, no system;" advertisement for SmartVent by DCI, Tapered Under—Shingle Attic Intake Ventilation, Jan. 2004.
Roofing Contractor, "Product Focus—Focus On—Ventilation", Aug. 2004.
Roofing Contractor, "Manufacturer Spotlight—DCI Products, Inc.—No Intake Vents, no System!", Jan. 2007.
Roofing Contractor, "Product Focus—Focus On—Ventilation", Mar. 2006.
Roofing Contractor, "Need Intake? Guaranteed Air Flow with Smart Vent", May 2007.
Western Roofing Magazine, "Flexible Flashing for Tile Roofs", Jan./Feb. 2006.
RCE, Inc., "A Well-built Roof Doesn't Always Keep the Water Out, Balanced Attic Ventilation is Key;" Horvat, Marianne, Interface, Jul. 2004, Jul. 2004.
Cor-A-Vent, Inc., Balanced Ventilation, How It Works; The Cor-A-Vent System, 2005.
Technical University of Budapest,"Design, Structural and Building Physical Problems for Built-Up Garret Spaces," Karacson, Sandor, et al.;Periodica Polytechnica Ser. Civil Eng.
Florida Solar Energy, Literature Review of the Impact and Need for Attic Ventilation in Florida Homes, Parker, Danny; Florida Solar Energy Center, May 31, 2005, May 31, 2005.
Millennium Metals, Inc., "Off Ridge Vent Installation," Millennium Metals, Inc., Dec. 22, 2006.
Ridgeline Incorporated, "Installation Instructions for Shingled Roofs," Ridgeline Ridge Vent System, Pre-2007.
RSI Magazine, "Attic Ventilation," Products Spotlight; SmartVent, DCI Products Inc., Nov. 2002.
Thompson Architectural Metals Company, "Product Evaluation Report for Round Top Off Ridge Vent with Baffle for Tile," Thompson Architectural Metals Company; Jul. 16, 2008.
Thompson Architectural Metals Company, "Off Ridge Roof Vent Installation," Thompson Architectural Metals, Jul. 14, 2008.
Trimline Building Products, "Complete Guide to Trimline Vent Requirements & Installation," Trimline Building Products, Sep. 2005.
Atlas Roofing Corporation, HV Evolution Data Sheet, Atlas Roofing, Apr. 2009.
NBP International, "Evolution Ridge Vents" presentation, 2007.
NBP International, "The ridge is the 'top' choice for ventilation," NBP Ridge Vents brochure, 2007.
Air Vent, Inc., "Attic Ventilation: The Five Most Frequently Asked Questions," Scelsi, Paul, Nov. 2003.
Trimline Building Products, "The Best Ridge Vent inPerformance, Attractiveness and Ease of Installation," Trimline Building Products Shingle-Over Ridge Vents brochure, 2005.
Trimline Building Products, Trimline Ventilation Products and Installation Instructions, 2007.
DCI Smart Vent, DCI Products, Inc., 2004-2007.
Trimline Building Products, Trimline® Shingle-Over Ridge Vents, 2005.
Cor-A-Vent, V-600E Ridge Vent, 2005.
Ridgeline Incorporated, Ridgeline® Ridge Vent, 1998.
Air Vent, Inc., Air Vent ShingleVent® II, 1992.
Air Vent, Inc., Air Vent ShingleVent® II-7, 1992.
Air Vent, Inc., Air Vent ShingleVent® II-9, 1992.
Air Vent, Inc., Air Vent ShingleVent® II-7A, 1992.
Air Vent, Inc., Air Vent ShingleVent® II-9A, 1992.
Air Vent, Inc., Air Vent VenturiVent Plus, 1992.
Benjamin Obdyke, Inc., Roll Vent®, 1991.
Greenstreak, Top CatTM, 1991.
North America Building Products, Inc., Ridgeline II®, 1991.
North America Building Products, Inc., Highpoint VentTM—Series 5, 1991.
The Solar Group, Inc., Easy-UpTM Shingle-Over Ridge Vent, 1991.
Browning Metal Products, VenturiVent PlusTM, 1991.
Lomanco, Inc., SOV-4®, 1991.
Tra-Mage, Inc., FlexVentTM, 2006.
Thompson Architectural Metals, Tamco Off-Ridge Roof Vent, 2009.
Atlas Roofing Corporation, Evolution Ridge Vent, 2007.
Air Vent, Inc., ShingleVent® II—High Performance Ridge Vent.
Air Vent, Inc., Multi-Pitch Filtervent®—High Performance Ridge Vent from Air Vent, 1996.
Air Vent, Inc., Proven Performance . . . Through Research, 1992.
DCI Products, Inc., DCI Products Inc. Smartvent and Smartridge at IRE show, 2007.
DCI Products, Inc., SmartVent by DCI, The Total Attic Ventilation System, Sep. 7, 2005.
DCI Products, Inc., SmartVent by DCI, Aug. 12, 2005.
DCI Products, Inc., SmartVent by DCI, Tapered Under-Shingle Attic Intake Ventilation, Nov. 7, 2005.
DCI Products, Inc. SmartVent by DCI, The Total Attic Ventilation System, 2006.
Roofing Contractor, SmartVent by DCI Products, Big Insurance News for the Roofing Contractor, Architect or Builder, Mar. 2004.
Roofing Contractor, Manufacturers Spotlight—DCI Products Inc., Complete Your Ventilation System, SmartVent by DCI, Jan. 2005.
Air Vent, Inc., Air Vent Multi-Pitch FilterVent®, 1992.
Air Vent, Inc., Air Vent Peak Performer ITM, 1992.
Air Vent, Inc., Air Vent Peak Performer IITM, 1992.
Air Vent, Inc., Air Vent VenturiVent RollTM. 1992.
Air Vent, Inc., Air Vent Easy UpTM, 1992.
Air Vent, Inc., Air Vent SLP Slant Back Plastic, 1992.
Air Vent, Inc., Air Vent SQP Square Plastic, 1992.
Air Vent, Inc., Air Vent B-144 Plastic Dome, 1992.

(56) References Cited

OTHER PUBLICATIONS

Air Vent, Inc., Air Vent Wall-Mount Vents, 1992.
Air Vent, Inc., Air Vent Airhawk® SLA Slant Aluminum, 1992.

* cited by examiner

ROOF VENT

CROSS REFERENCE TO RELATED APPLICATIONS

Not applicable.

FEDERALLY SPONSORED RESEARCH AND DEVELOPMENT

Not applicable.

MICROFICHE APPENDIX

Not applicable.

BACKGROUND OF THE INVENTION

(1) Field of the Invention

The present invention relates to roof vent systems for building structures, to facilitate air circulation within the structure. More particularly, the invention disclosed herein relates to vents capable of obstructing air gaps that may exist or form between the vent and its substratum such as the roof decking or shingles. Height differences between adjacent shingles, or irregularities in roof decking, may create gaps allowing moisture and other undesirable matter to enter the structure. Hence the need for a vent capable of obstructing such air gaps.

(2) Background of Invention

Appropriate attic ventilation systems permit a constant flow of exterior air through the attic, protecting the efficiency of the insulation and helping to lower temperatures in the dwellings. Constant air intake and exchange between living spaces inside the house and outside the house is necessary to prevent buildup of heat and moisture during hot summer time, or household activities such as cooking, showering, and doing laundry. Increased moisture and temperatures also increase the cost of cooling the structure, and it damages roofs and insulation materials. Inconsistent air flow during elevated temperatures can also create ideal conditions for mold growth and formation of spores in large quantities. They are a health hazard to humans, potentially causing allergic reactions and respiratory problems.

There are vents known in the prior art that are arguably material to the patentability of the invention claimed herein. U.S. Pat. No. 6,212,833 discloses a roof vent device formed from upper and lower outer surfaces sized to define a generally rectangular configuration having a linear axis. A tapered matrix is positioned between the outer surfaces, the taper being directed in a direction perpendicular to the axis to define a thin linear edge and a thick linear edge along the outer edges of the configuration that are parallel to the axis and tapered linear edges along the outer edges of the configuration that are perpendicular to the axis. The tapered matrix has a gap for air entry for an air to vent air from beneath the roof ridge out the thick linear edge located proximate the middle of the tapered linear edges and extending generally over the linear axis of the outer surfaces. The gap further provides a pivot point about which the configuration folds to conform to a roof pitch having a predetermined angle. In one embodiment the matrix is tapered from one outer edge to the gap and the remaining portion of the matrix is generally level.

U.S. Pat. No. 6,881,144 discloses a ridge vent including an elongated flexible member having a central panel portion comprising support means for supporting the central panel above a roof, a pair of side portions containing a vent opening and a baffle. The baffle is adjustable from a relatively flat position to a relatively vertical position with respect to the roof. Having an adjustable baffle permits the ridge vent to be rolled more easily, and assists in lower cost molding of the vent.

U.S. Patent Application Publication No. 2008/0287054 discloses a ridge vent comprising an elongated panel with two opposed lateral edges; a pair of elongated sidewalls extending downward from one of the lateral edges; a pair of elongated floor portions each extending outward from one of the sidewalls. One or more of the floor portions has an underside having a sealant to improve the seal between the floor portion and the roof.

U.S. Patent Application No. 2010/0144266 describes a roof ridge vent that includes a base portion configured to extend generally longitudinally along the ridge, and a plurality of vent extension members extending down from the base portion. The extension members form passages to vent air exiting the vent opening, and direct the air beneath and out of the sides of the vent. The extension members set at an angle to the longitudinal direction of the vent. The vent also includes V-shaped filter members attached to the vent with the small end of the V adjacent the base portion.

U.S. Pat. No. 8,790,167 discloses a vent which substantially fills in and seals spaces between the exterior surface of the roof and the vent. Its mechanism includes transverse support members extending outwardly from the inner surface of the body, wherein each of the transverse support members includes an outer edge spaced from the inner surface of the body, the outer edge including a cutout spaced from the inner surface of the body. The mechanism also includes elongated resilient members extending across the width of the vent body, each cooperating with a corresponding number of the cutouts; each of the elongated resilient members includes a separate member that is a dual durometer component, including a mounting portion disposed in the cutout and having its composition harder along its length than the composition of the sealing portion (having its composition soft along its length), and structured to extend outwardly from the mounting portion toward the roof.

None of these references, standing alone, expressly discloses a roof vent system with a plurality of downwardly biased flanges that obstruct gaps between the vent and the roof substratum.

One object of the invention disclosed herein is to provide a means of obstructing gaps between the vent and the roof.

Another object of the invention disclosed herein is to provide a means of obstructing gaps between the vent and the roof, outside the vent cavity.

Another object of the invention disclosed herein is to provide a means of obstructing gaps between the vent and the roof, using materials having the durability, longevity and structural rigidity of the vent.

Other objects will become apparent from the disclosure.

BRIEF SUMMARY OF THE INVENTION

The present invention concerns an improved roof vent system for structures, which obstructs gaps between the vent and the substratum (such as the roof decking or shingles). Gaps often occur between the vent and the roof decking or shingles (105), allowing the unwanted entry of wind, precipitation and insects. To remedy such problems, the vent system must be attached completely to the roof surface without any gaps. Often roofs do not have an absolutely flat surface. It is difficult to create a ventilation system which guarantees continuous solid contact with the roof surface, while also filling any gaps between the roof surface and the vent. It is generally most advantageous for roof vents to have a solid or rigid edge contacting the roof, while assuring that such gaps are filled or minimized. The present invention generally includes a vent system maintaining rigid contact with the roof substratum, while also having a plurality of flexible gap-obstructing flanges that are biased downwardly to obstruct any gaps before the enclosed portion of the vent.

Figure 1:
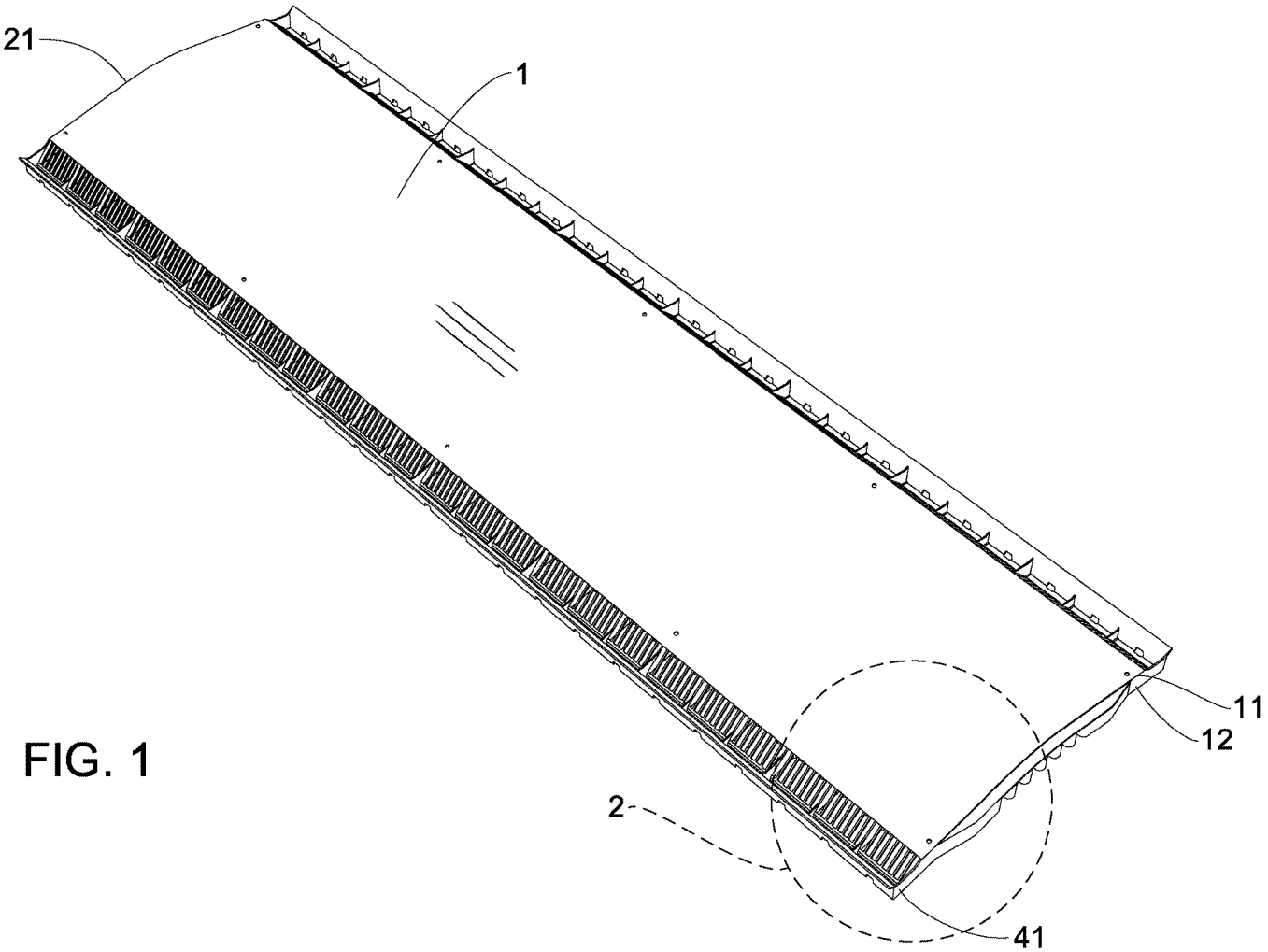
FIG. 1 depicts a top perspective view of a representative sample of a roof vent of the present invention.
Figure 2:
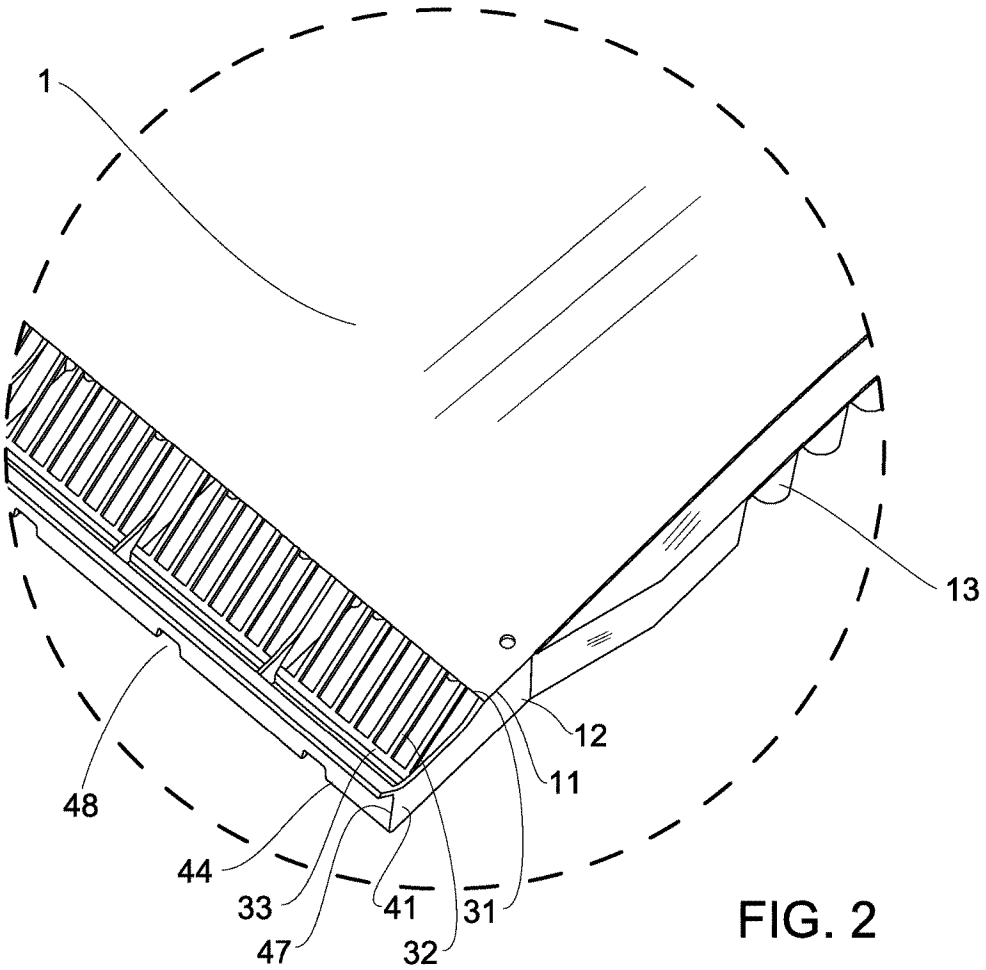
FIG. 2 depicts a close-up view of the encircled portion of the roof vent of FIG. 1.
Figure 3:
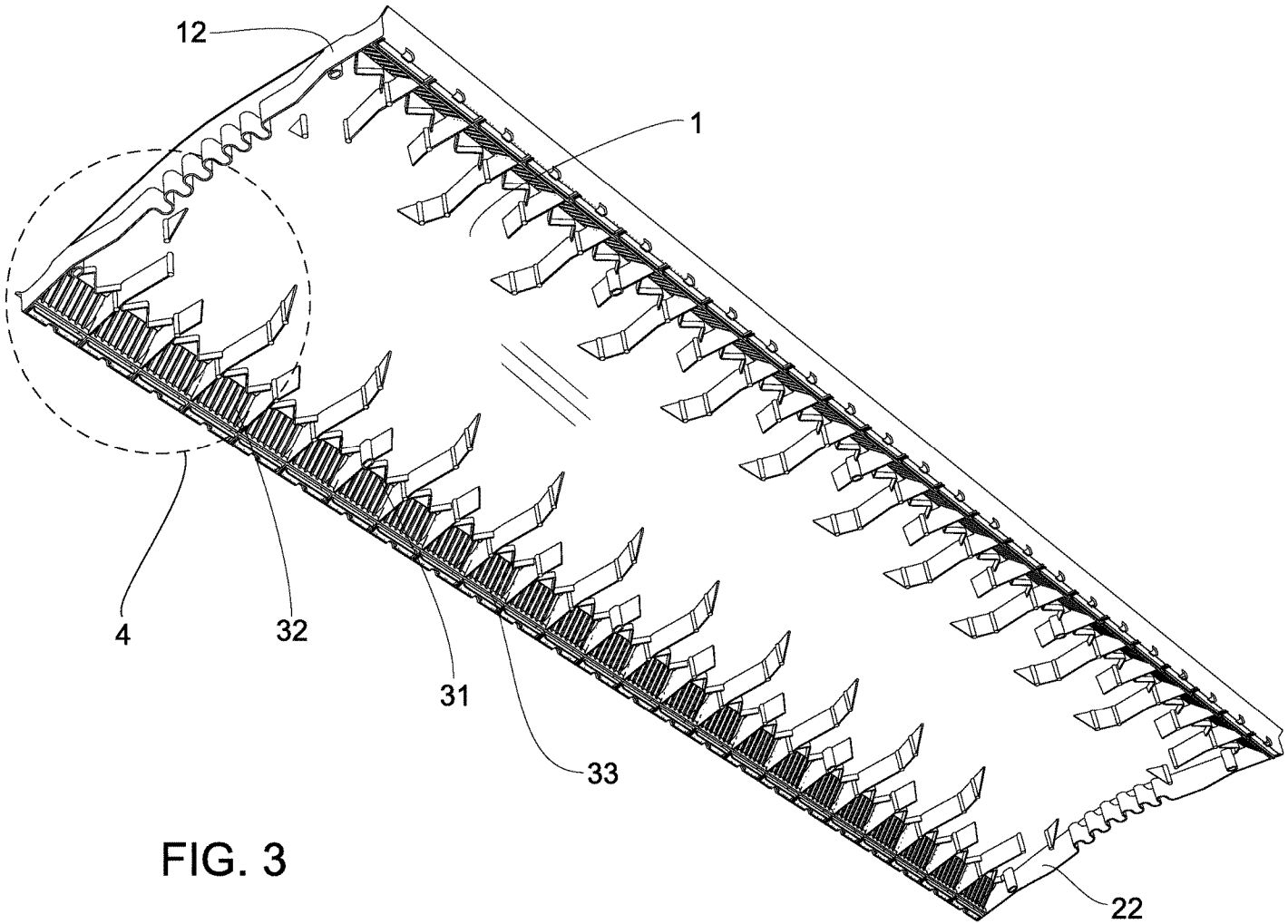
FIG. 3 depicts a bottom perspective view of the roof vent of FIG. 1.

The dashed lines encircling portions of the roof vent are for illustrative purposes.

DETAILED DESCRIPTION OF THE INVENTION

The terminology used herein is for the purpose of describing particular embodiments only and is not intended to be limiting. As used herein, the singular forms "a", "an", and "the" are intended to include the plural forms as well, unless the context clearly indicates otherwise. It will be further understood that the terms "comprises" and/or "comprising", or "includes" and/or "including", or "have" or "having", when used in this specification, specify the presence of stated features, regions, integers, steps, operations, elements, and/or components, but do not preclude the presence or addition of one or more other features, regions, integers, steps, operations, elements, components, and/or groups thereof.

For the sake of simplicity and to give the claims of this patent application the broadest interpretation and construction possible, the conjunctive "and" may also be taken to include the disjunctive "or," and vice versa, whenever necessary to give the claims of this patent application the broadest interpretation and construction possible. Likewise, when the plural form is used, it may be taken to include the singular form, and vice versa.

It will be understood that, although the terms first, second, third, etc. may be used herein to describe various elements, these elements should not be limited by these terms. These terms are only used to distinguish one element from another element.

The disclosure herein is not limited by construction materials to the extent that such materials satisfy the structural and/or functional requirements. For example, any material may be used so long as it satisfies the rigid structural and functional requirements for which it is being used. In one embodiment, the device and/or system is pliable plastic material; however, any material of sufficient rigidity and flexibility will suffice as well. Likewise, the invention is not limited by any construction process or method. The invention disclosed herein may be constructed by injection molding, or any other method that will produce a vent having the necessary rigidity and flexibility.

In general, the invention disclosed herein comprises (includes) a vent for a roof or other structure, which may include a cavity housing portion and an outside-housing extension portion associated therewith. The housing portion may include a plurality of enclosure sidewalls downstanding from a top plate and a ventilation side downstanding from the top plate. The outside-housing extension portion may include an extension footing extending from a lower edge of the ventilation side; the extension footing further may include a means of obstructing gaps between the extension footing and the structure.

The means of obstructing gaps may include the extension footing having an obstructing portion biased downwardly below the extension footing. The obstructing portion may include a plurality of obstructing sub-portions, each resiliently biased downwardly below the extension footing. The extension footing further may include a plurality of slats, each extending from the lower edge of the ventilation side before merging into a corner-edge connecting all of the slats. The extension footing further may include a plurality of tabs, each integral with the corner-edge and extending between a respective pair of the slats, each of the tabs resiliently biased downwardly below the extension footing. The plurality of the tabs may include a free edge opposite the corner-edge and forming a flange angularly downstanding below the extension footing.

The extension footing corner-edge may merge into a wind deflector face upstanding therefrom. The corner-edge may further define at least one drainage opening; preferably, the vent will include a plurality of drainage openings spaced periodically along the corner-edge.

The ventilation side may include a plurality of ventilation openings, functioning as air louvers.

The vent disclosed herein may function as an off-peak vent, as well as a ridge vent.

The vent functions well as a ridge vent, perhaps straddling the roof ridge so that a ventilation side is on each side of the ridge. The plurality of enclosure sidewalls may include a first sidewall and an opposite second sidewall, each of the sidewalls having a flexion region. The housing portion further may include a second ventilation side opposite the first mentioned ventilation side, and a second outside-housing portion opposite the first mentioned outside-housing portion. Each ventilation side and outside-housing portion may have essentially the same features and facets, perhaps mirror images of the other respective ventilation side and outside-housing portion. The flexion regions may allow the bending of the vent for installing the vent straddling a ridge of the structure, with the first mentioned ventilation side and first outside-housing portion on one side of the ridge and with the second ventilation side and second outside-housing portion on the other side of the ridge.

The top plate further may include at least one air baffle downstanding therefrom. In one preferred embodiment, the air baffle may have a zig zagging configuration from the first sidewall to the second sidewall. In the alternative or conjunctive, the top plate may include at least one support baffle downstanding therefrom, providing rigid support maintaining the cavity within the housed portion. Preferably the top plate may include a plurality of support baffle downstanding therefrom; these may also function as air baffles as well.

Figure 4:
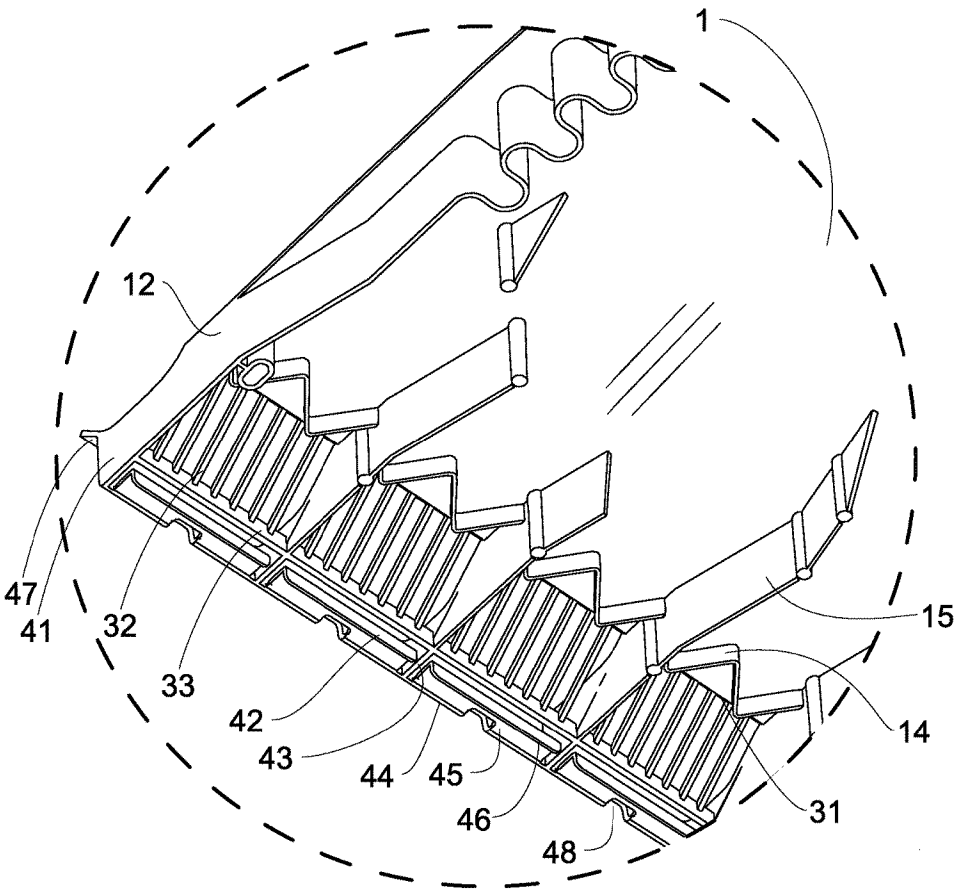
FIG. 4 depicts a close-up view of the portion encircled in FIG. 3.
Figure 5:
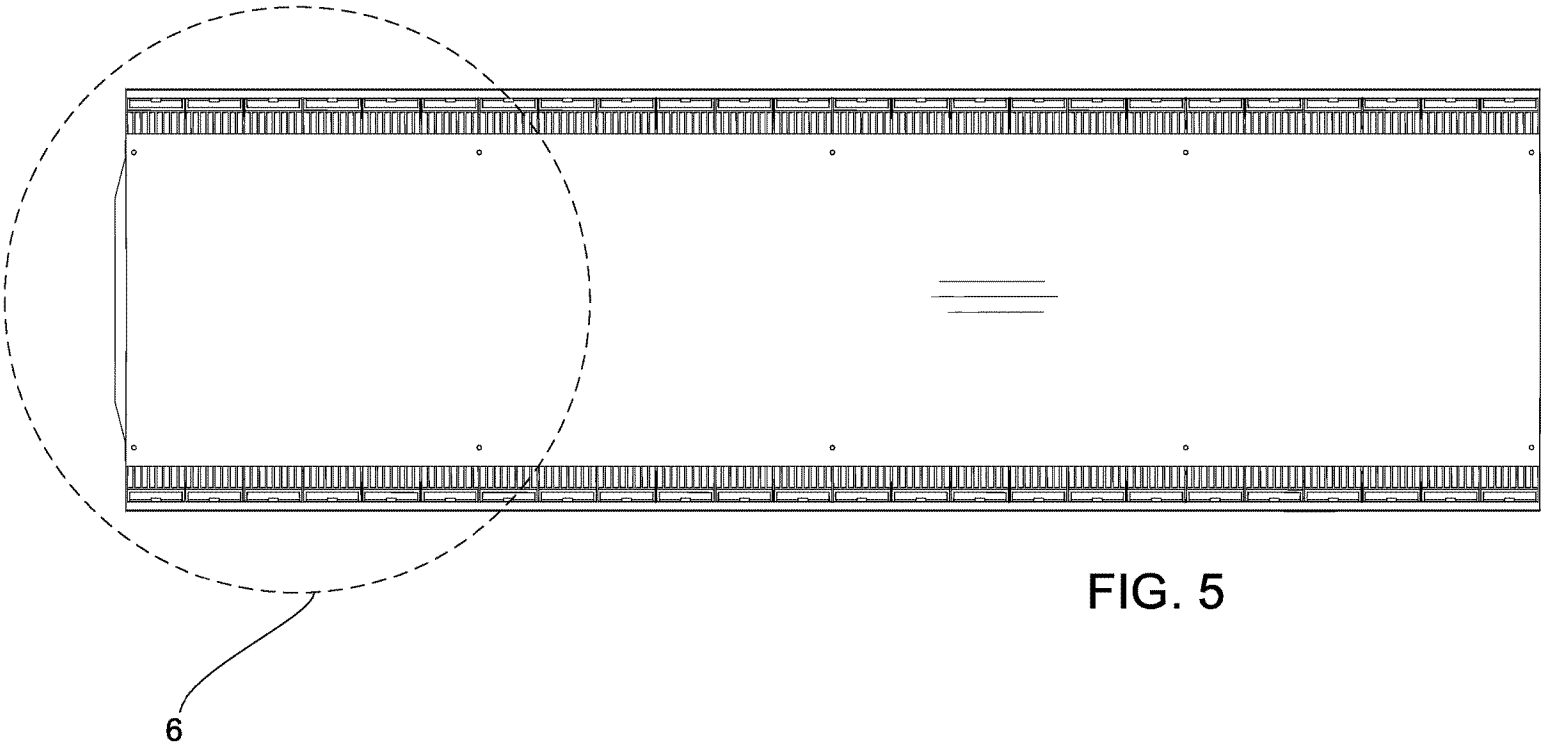
FIG. 5 depicts a top plan view of the roof vent of FIG. 1.
Figure 6:
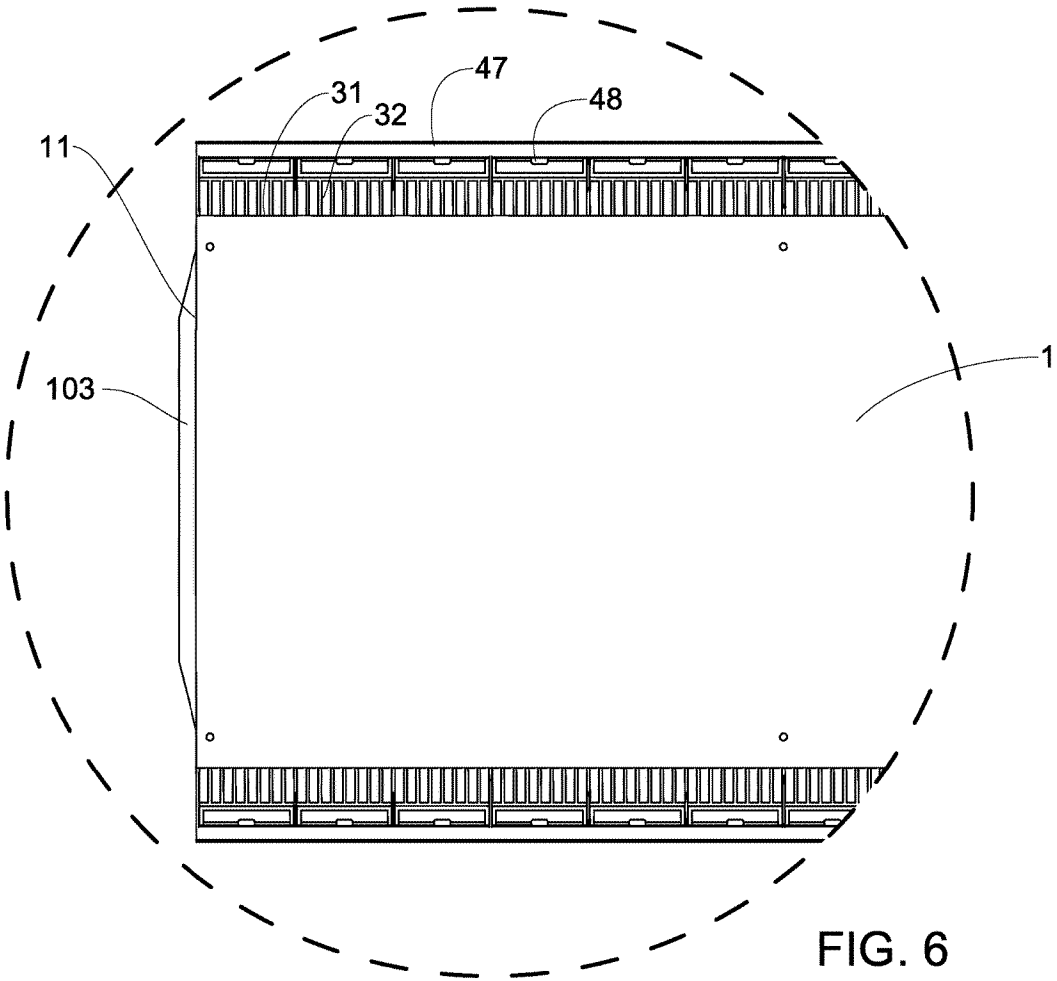
FIG. 6 depicts a close-up view of the portion encircled in FIG. 5.
Figure 7:
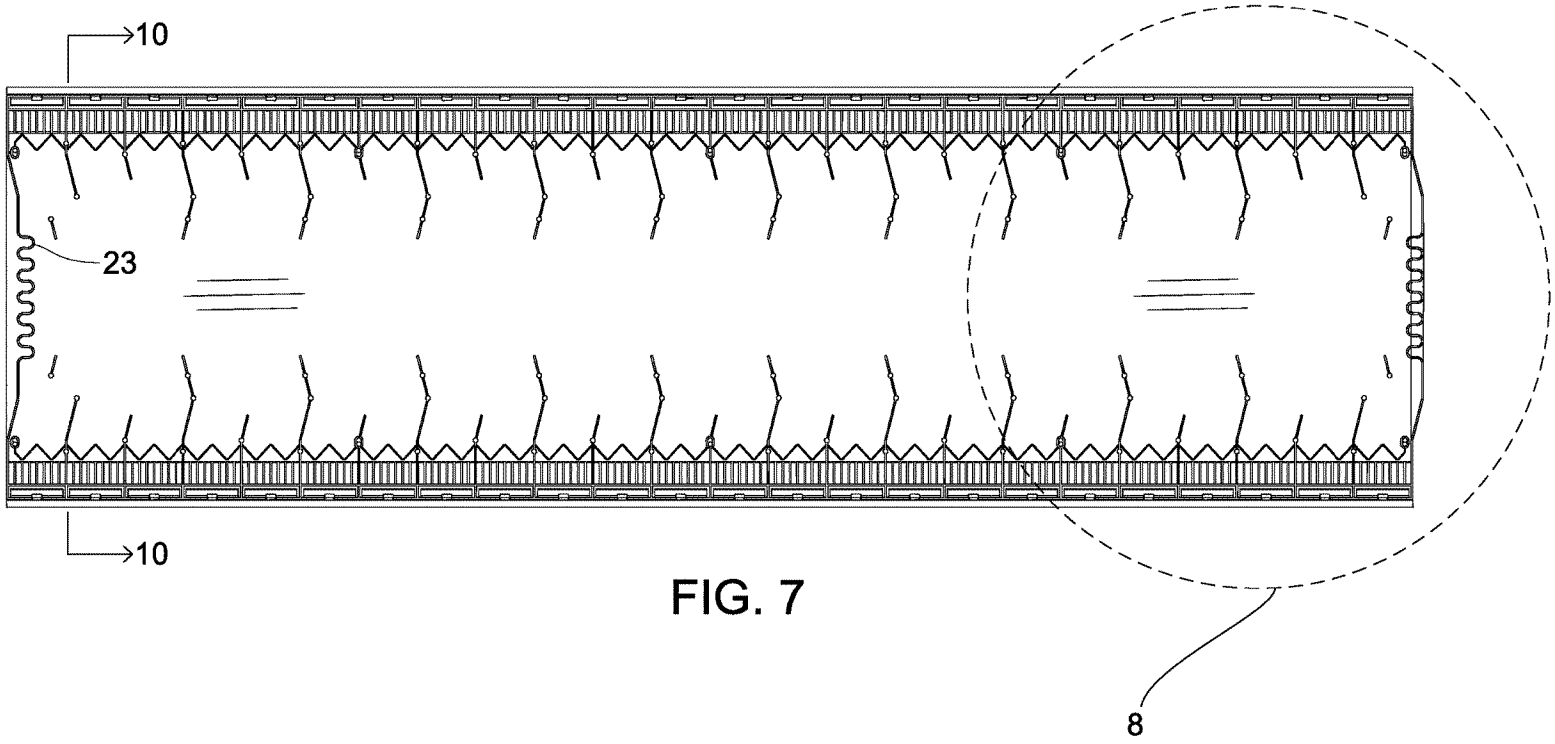
FIG. 7 depicts a bottom plan view of the roof vent of FIG. 1.
Figure 8:
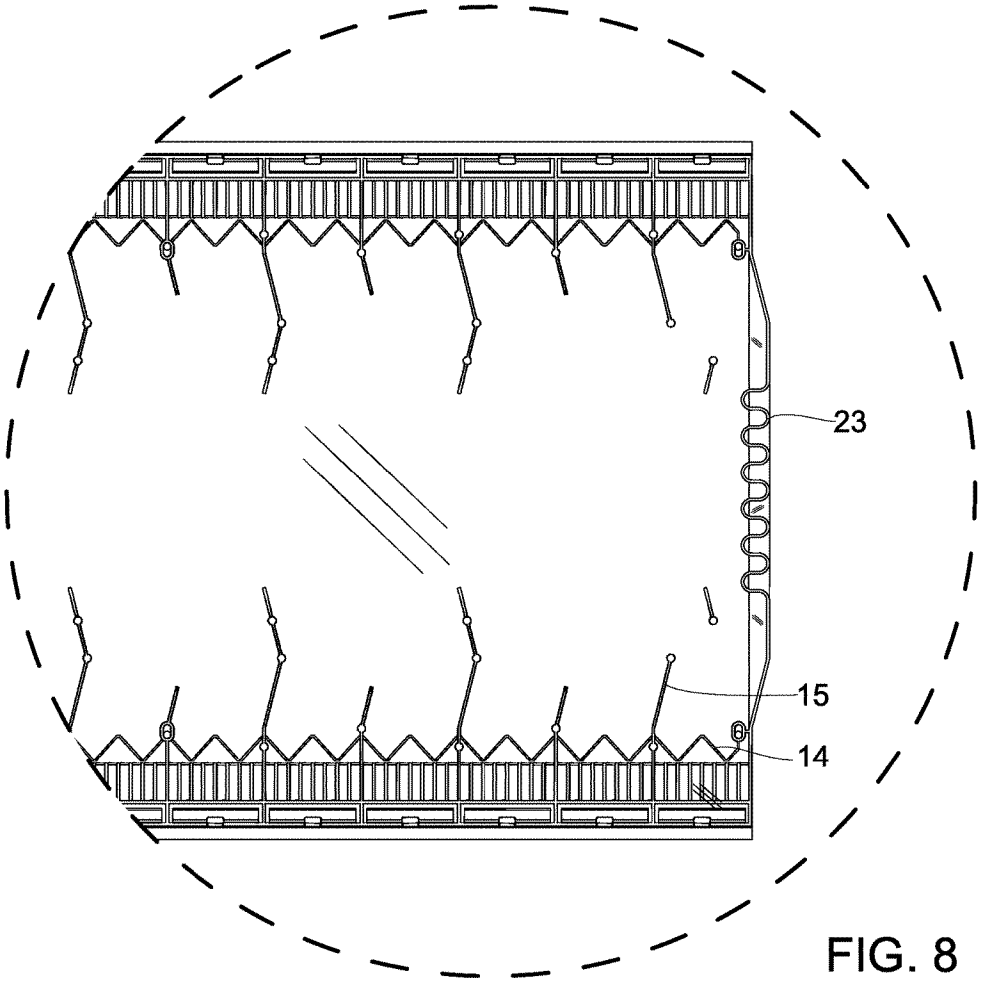
FIG. 8 depicts a close-up view of the portion encircled in FIG. 7.
Figure 9:
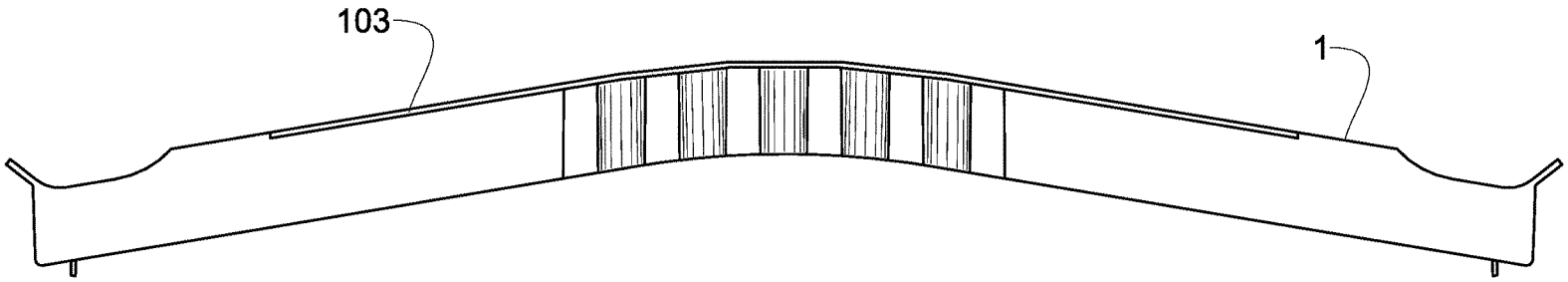
FIG. 9 depicts a second side elevation view of the roof vent of FIG. 1, in a resting configuration.
Figure 10:
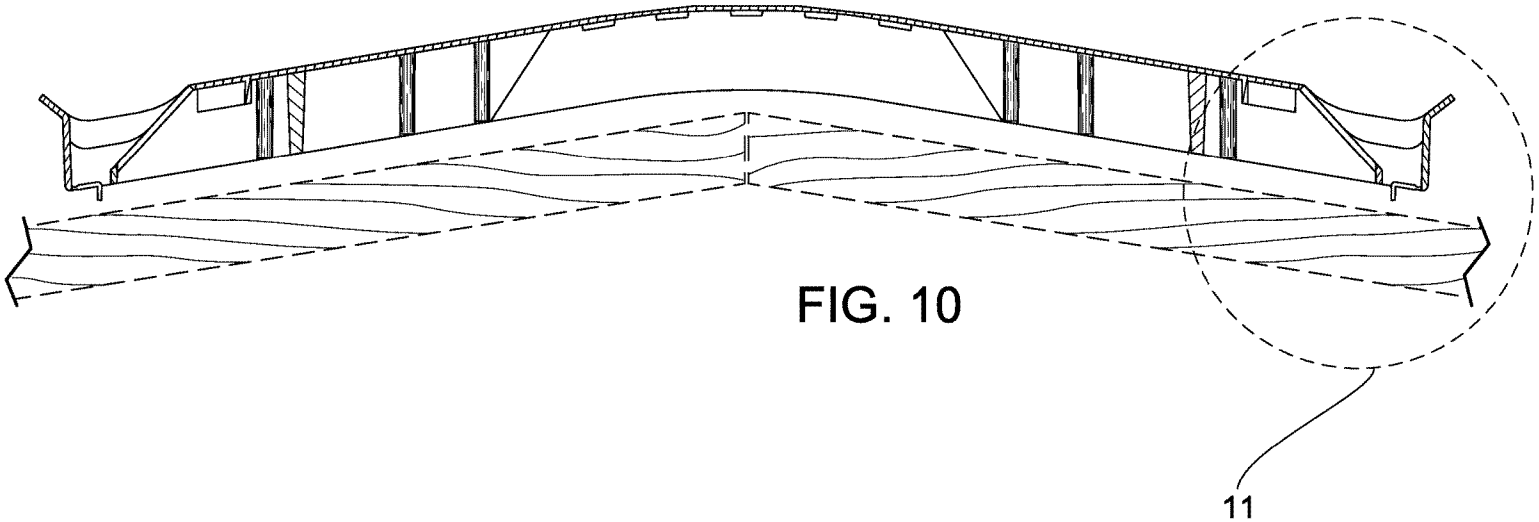
FIG. 10 depicts a cross section of the roof vent of FIG. 1, at plane 10-10 of FIG. 7.
Figure 12:
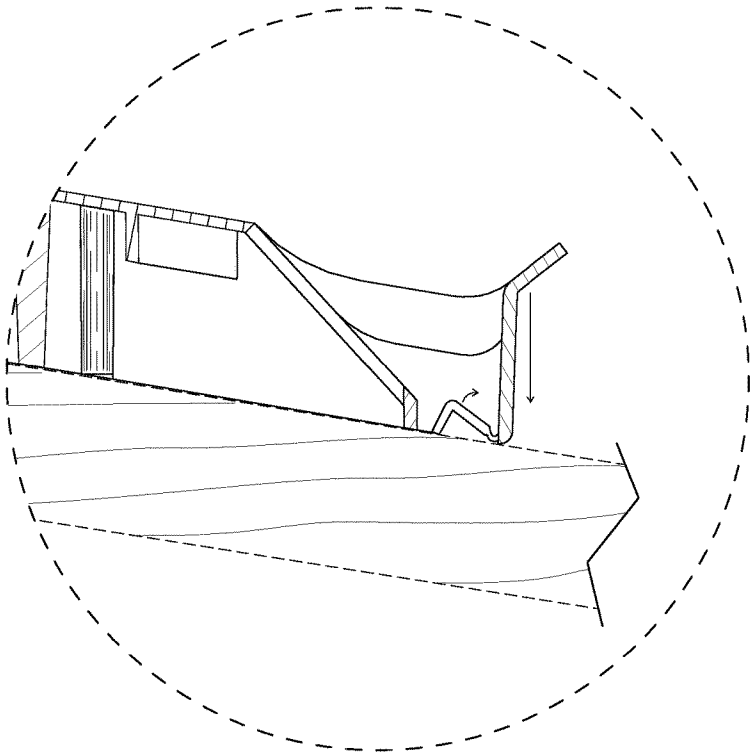
FIG. 12 depicts the view of FIG. 11, but after the flange has been compressed against roof substratum.
Figure 11:
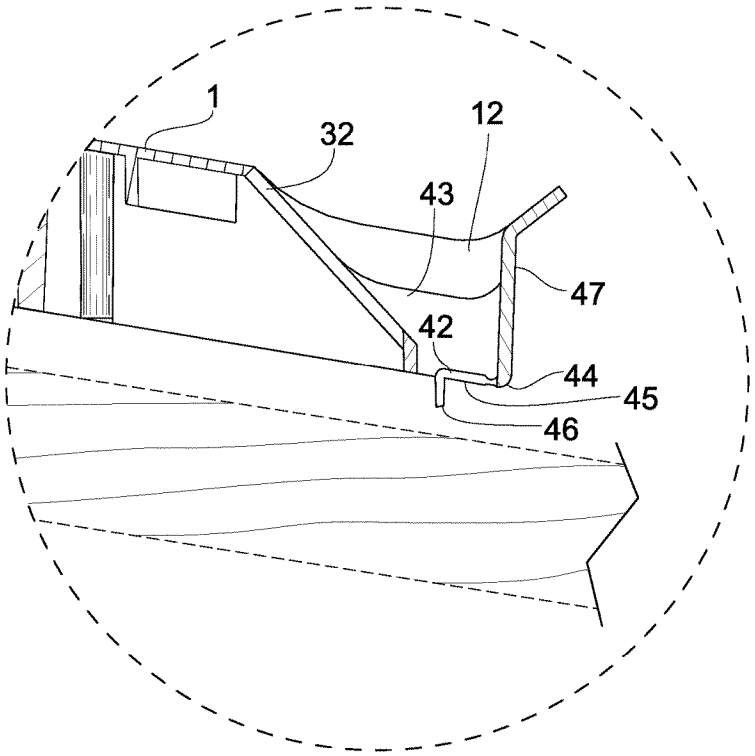
FIG. 11 depicts a close-up view of the portion encircled in FIG. 10, before being compressed against roof substratum (unclaimed).
Figure 13:
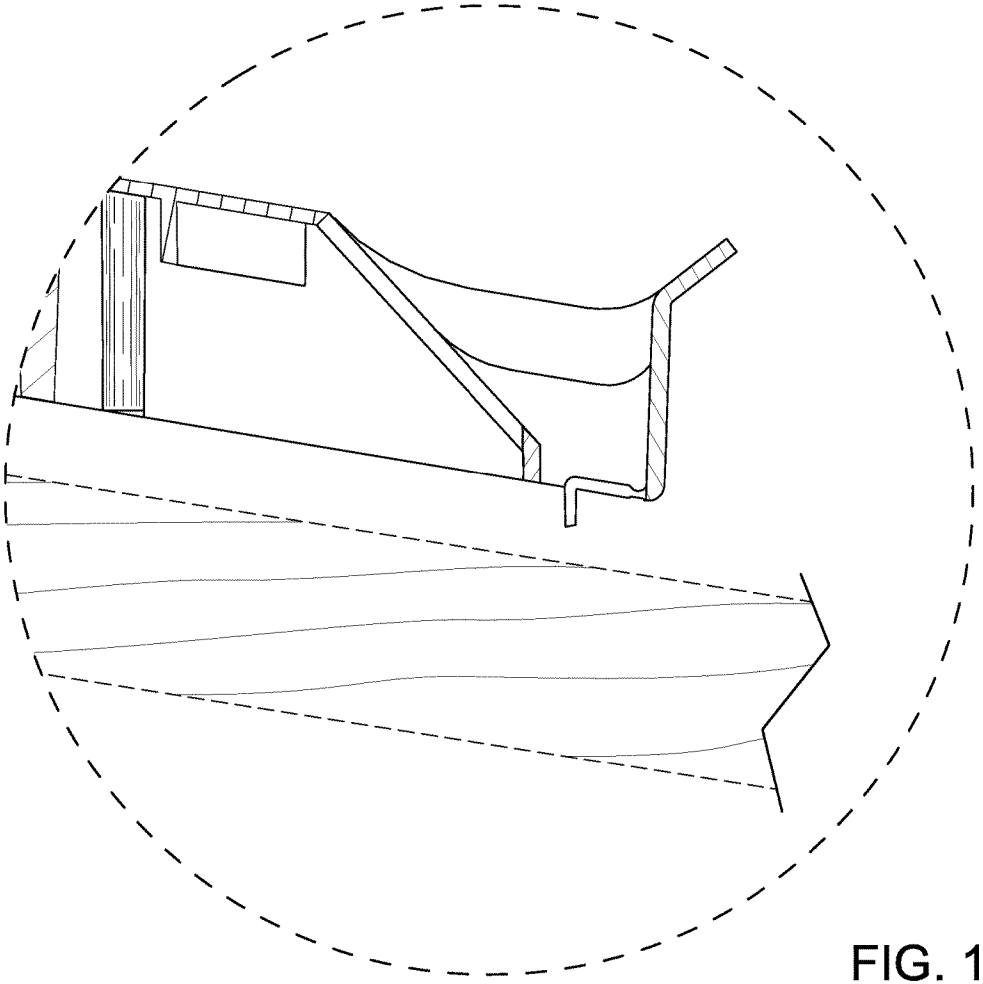
FIG. 13 depicts a first side elevation view of the roof vent of FIG. 1, in a resting configuration.
Figure 14:
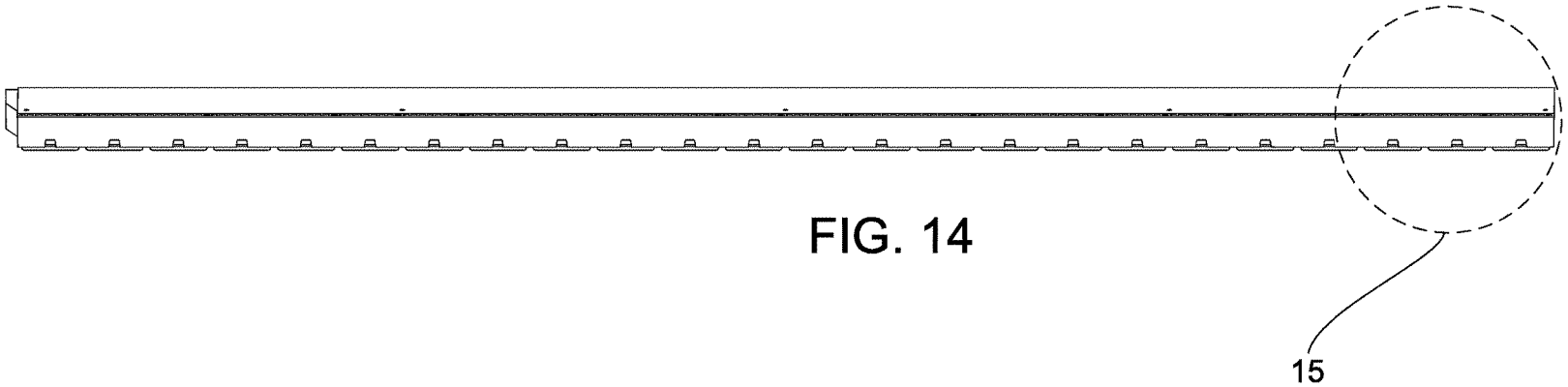
FIG. 14 depicts a front elevation view of the roof vent of FIG. 1.
Figure 15:
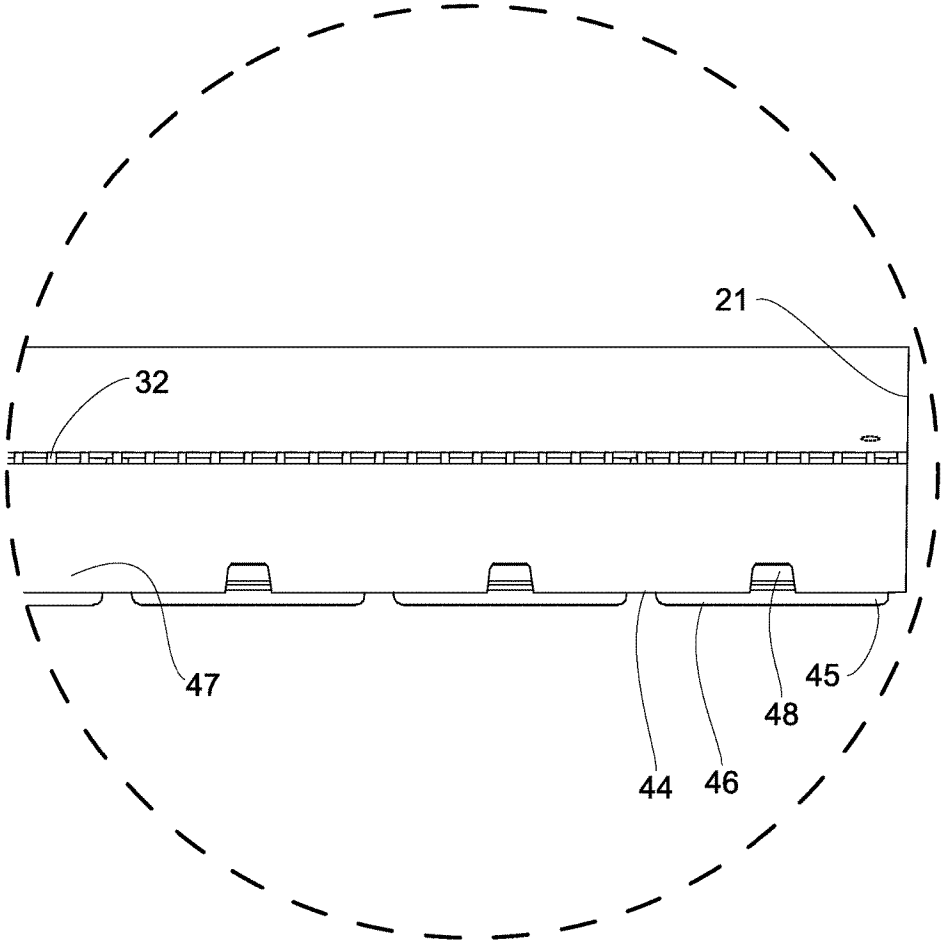
FIG. 15 depicts a close-up view of the portion encircled in FIG. 14.
Figure 16:
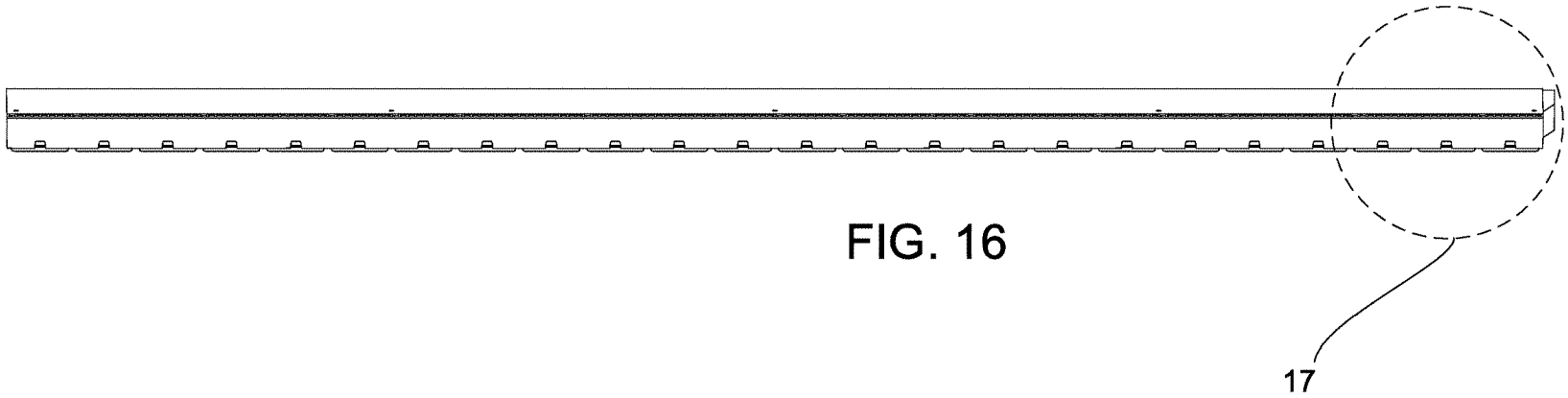
FIG. 16 depicts a rear elevation view of the roof vent of FIG. 1.
Figure 17:
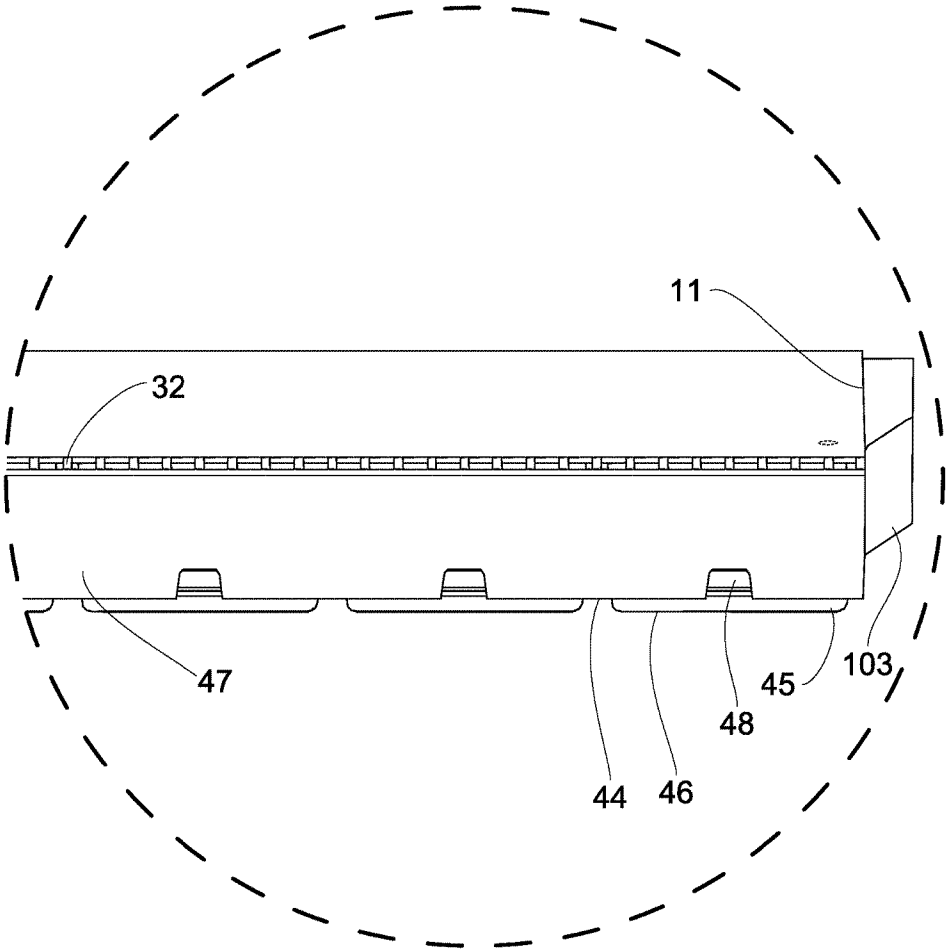
FIG. 17 depicts a close-up view of the portion encircled in FIG. 16.
Figure 18:
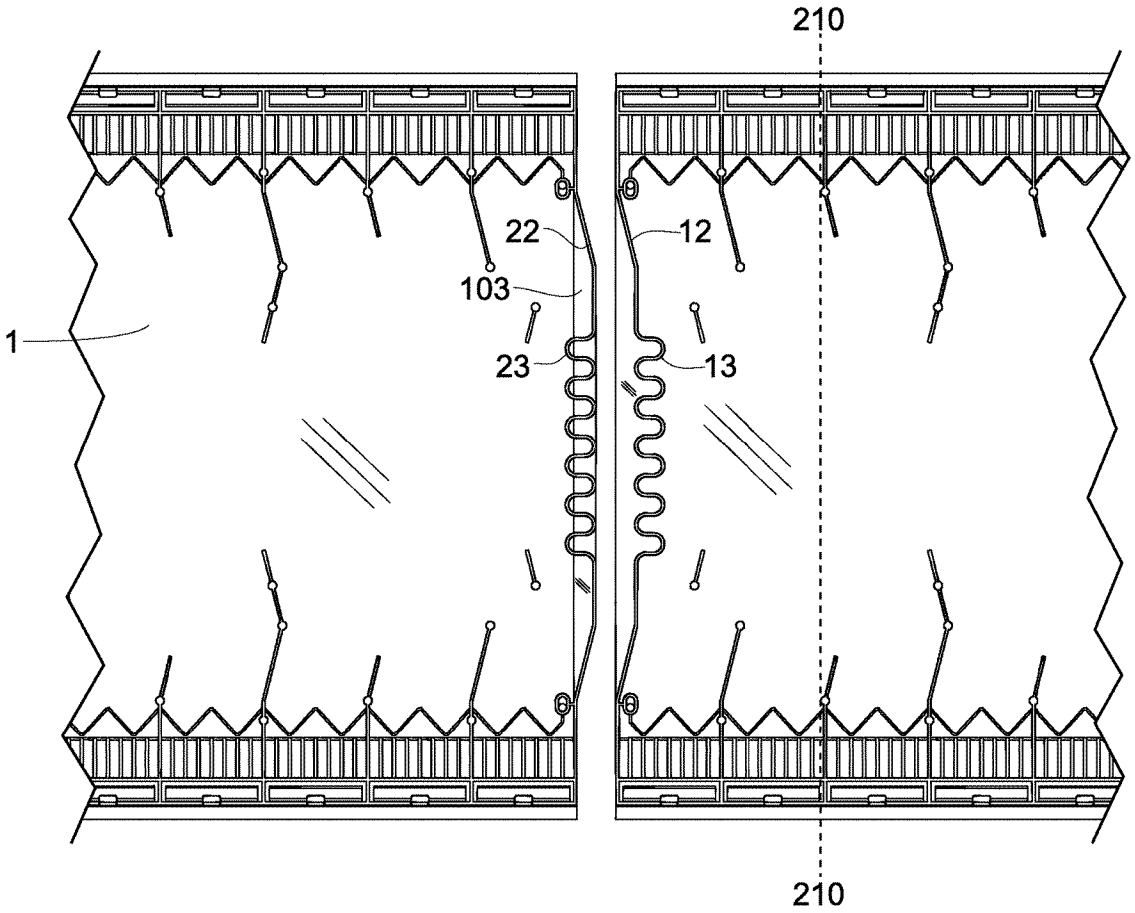
FIG. 18 depicts a bottom plan view of the matable portions of two separate side-by-side vent units, the left unit having a "male" portion and the right unit having a female portion with overhanging top plate. The dotted line 210-210 shows a hypothetical line where the right unit may be cut shorter for installation purposes, as shown in FIG. 21.
Figure 19:
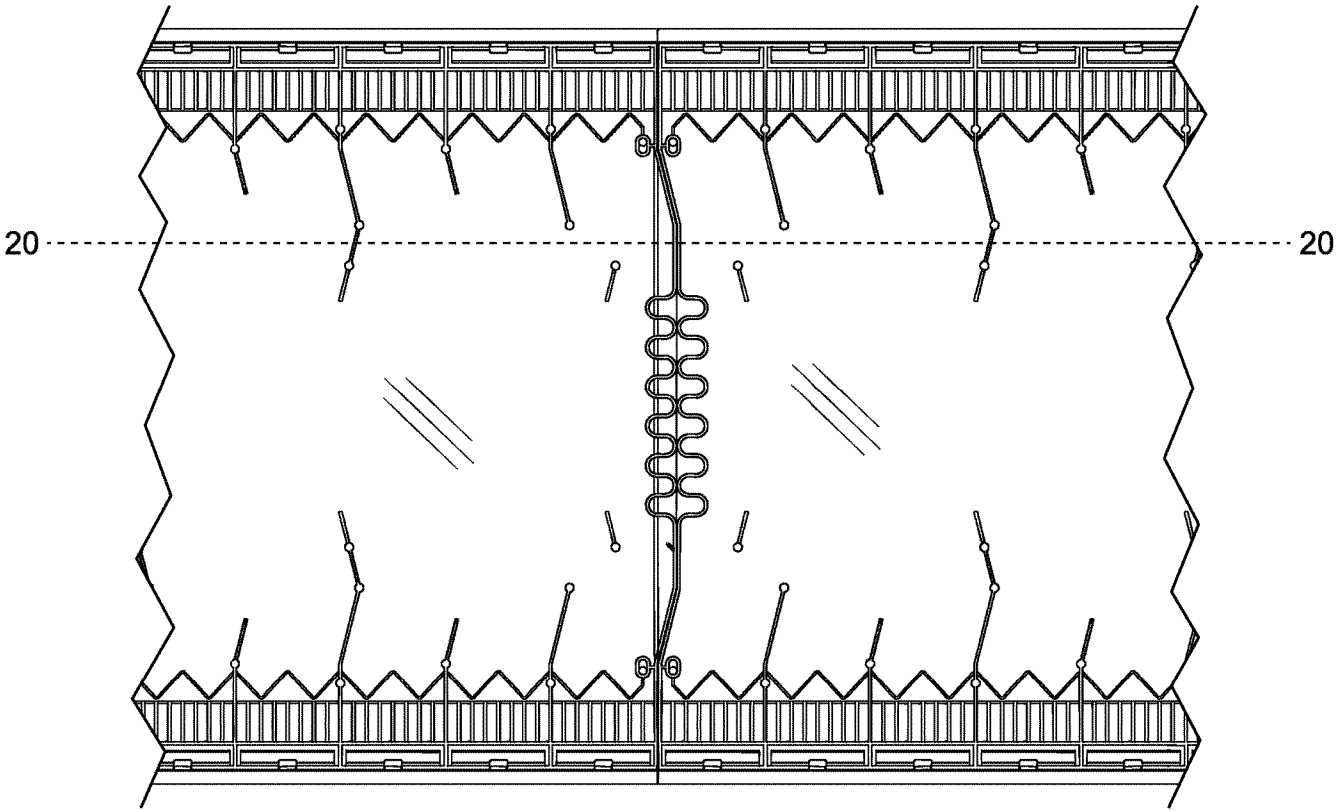
FIG. 19 depicts a bottom plan view of the mating portions of the two vent units of FIG. 18; dashed line 20-20 shows the plane of cross-sectioning depicted in FIG. 20.
Figure 20:
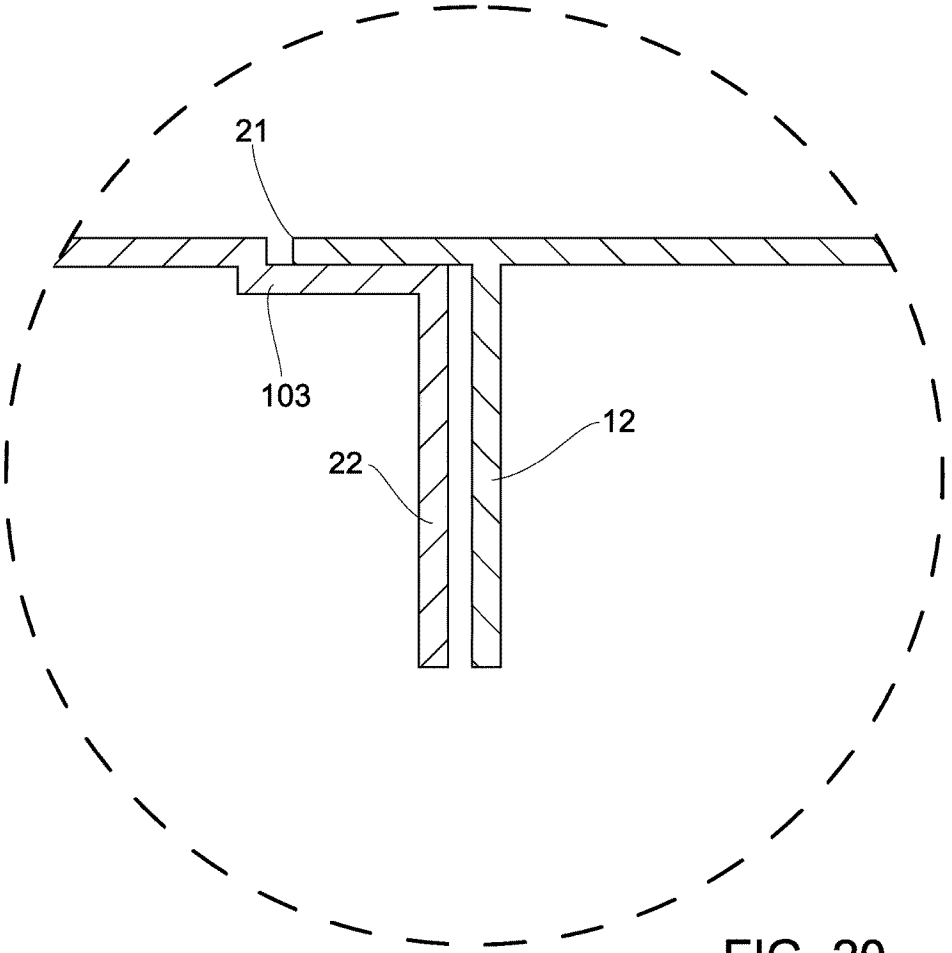
FIG. 20 depicts a close-up of a side elevation cross-section view of a portion of the mated units at the plane 20-20 of FIG. 19, showing the top plate of the female portion of the right unit overlapping the male ledge portion (103) of the left unit.
Figure 21:
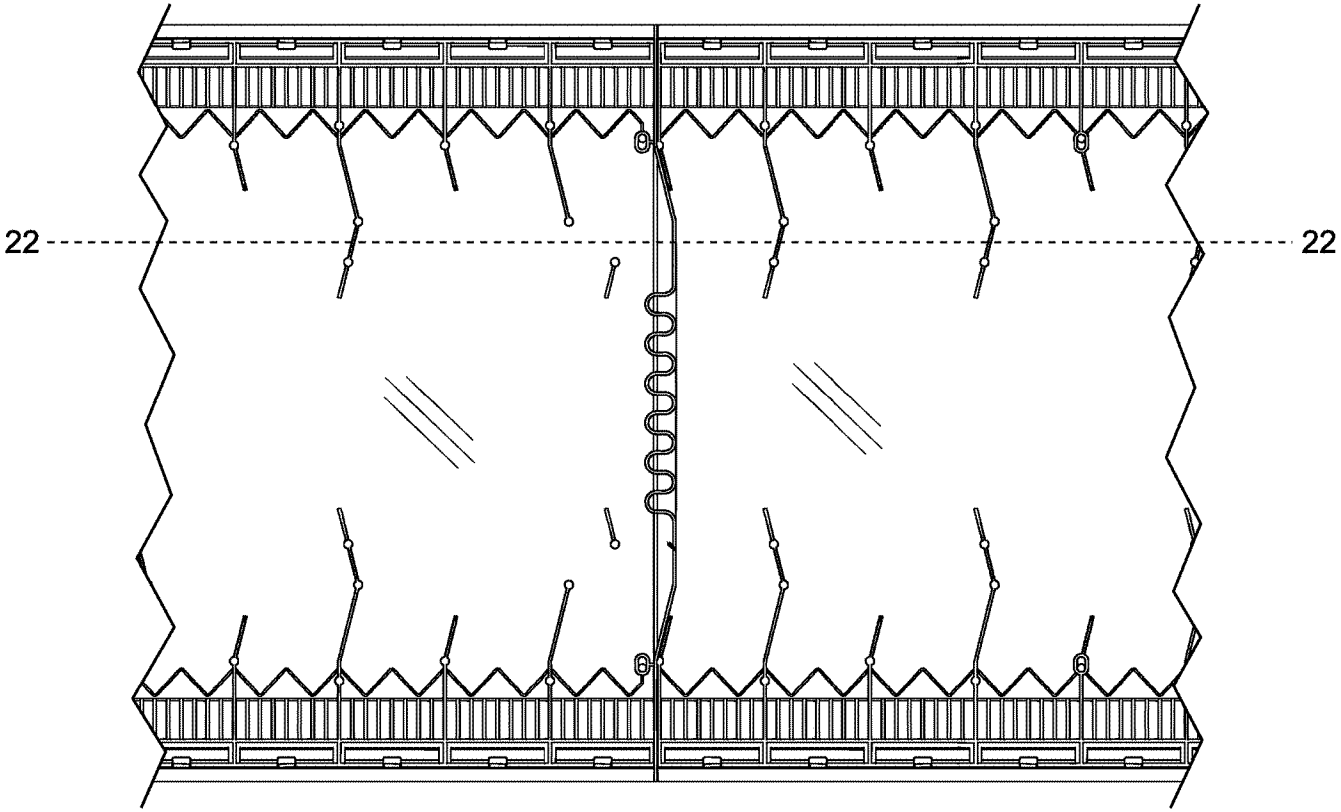
FIG. 21 depicts a bottom plan view of the mating portions of the two vent units of FIG. 18, after the width of the right unit has been cut shorter at the dotted line 210-210 of FIG. 18; dashed line 22-22 shows the plane of cross-sectioning depicted in FIG. 22.
Figure 22:
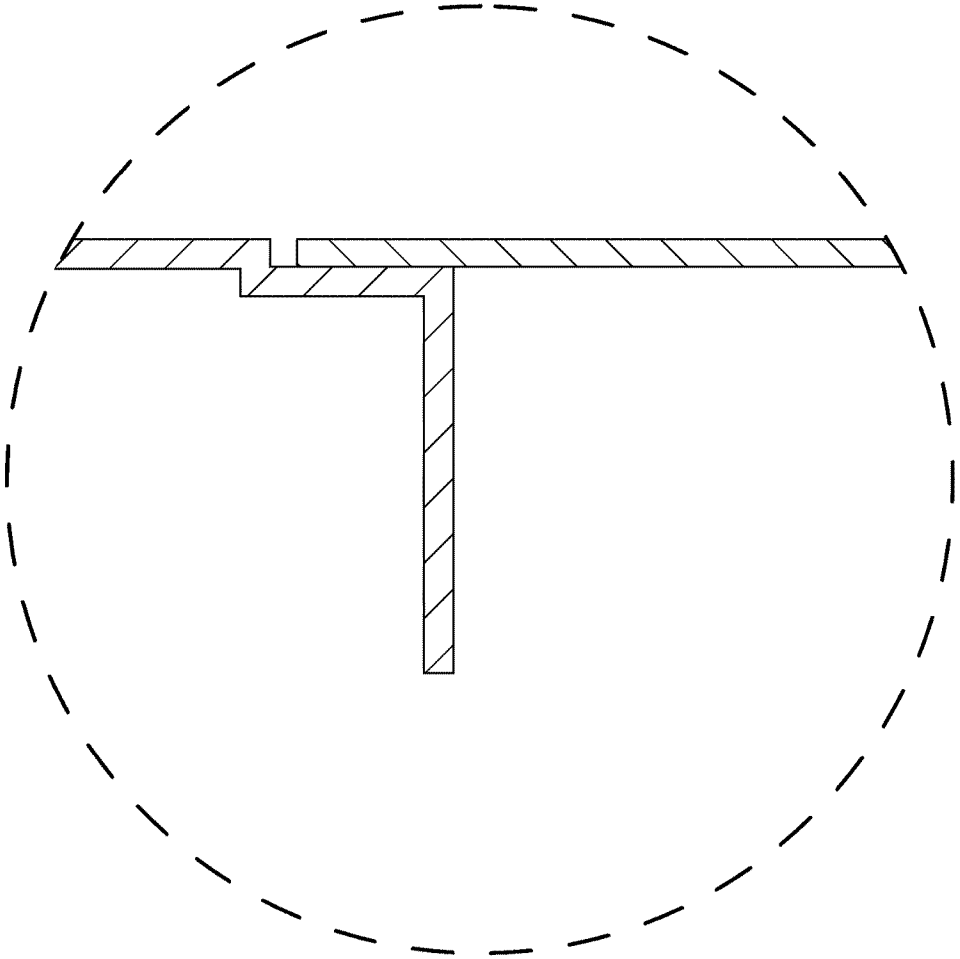
FIG. 22 depicts a close-up of a side elevation cross-section view of a portion of the mated units at plane 22-22 of FIG. 21, showing the top plate of the female portion of the right unit overlapping the male ledge portion of the left unit.
Figure 23:
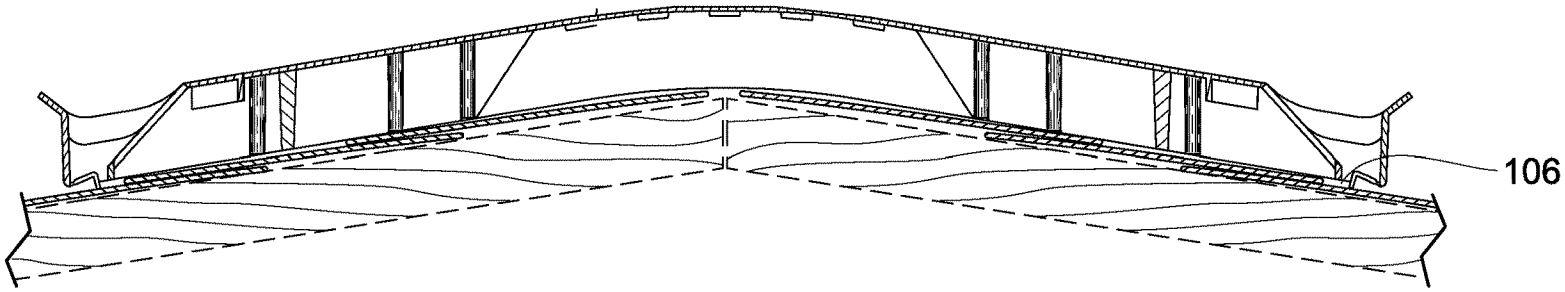
FIG. 23 depicts a cross-section of the roof vent, installed over the ridge of a roof.

FIG. 4 shows the interior of a representative sample of the vent. A ventilation side is formed by ribs or louvers (32) connecting the ventilation edge (31) of the top plate and the lower edge (33) of the extension footing (41). Outside the housing cavity, the extension footing has a foremost corner edge (44) from which tabs (45) extend to obstruct any gap. The corner edge has several functions, biasing the tabs downwardly below the extension footing while providing drainage and supporting a foremost wind-deflector face (47).

The side walls of the vent may be wave-form or serpentine surfaces that allow a certain amount of flexibility to the top plate, especially when the vent is intended to straddle the roof ridge. The absence of the rib support structure in the middle of the inner surface of the top plate makes the vent more flexible in the middle part of the housing.

One preferred embodiment of the invention comprises a vent for a roof or other structure, which may include a cavity housing portion and a first outside-housing extension portion associated therewith:

(a) the housing portion may include:
(1) a top plate (1) having a first edge (11), a second edge (21) and a ventilation edge (31),
(2) a first sidewall (12) downstanding from the first edge;
(3) a second sidewall (22) downstanding from the second edge; and
(4) a ventilation side downstanding from the ventilation edge and including a lower edge (33) opposite thereto and connecting ribs (32); and
(b) the first outside-housing portion may include:
(1) an extension footing (41) extending from the lower edge of the ventilation side; and
(2) a means of obstructing gaps (106) between the extension footing and the structure, which may include the extension footing having at least one obstructing portion biased downwardly below the extension footing.

The extension footing may include a plurality of obstructing sub-portions (42), each resiliently biased downwardly below the extension footing. The extension footing further may include a plurality of slats (43), each extending from the lower edge of the ventilation side before merging into a corner-edge (44) connecting all of the slats. The extension footing further may include a plurality of tabs (45), each integral with the corner-edge and extending between a respective pair of the slats; each of the tabs may include a free edge (46) opposite the corner-edge and forming a flange angularly downstanding and resiliently biased below the footing.

The extension footing corner-edge may merge into a wind deflector face (47) upstanding therefrom, and with the corner-edge further defining at plurality of drainage openings (48).

Each of the sidewalls may have a flexion region. One embodiment of such a flexion region may be a serpentine section (13) of sidewall, preferably aligned with a similarly serpentine section (23) of the opposite sidewall (which may be mirror images of each other). The housing portion further may include a second ventilation side opposite the first mentioned ventilation side and a second outside-housing portion opposite the first mentioned outside-housing portion. The flexion regions may allow the bending of the vent along its longitudinal axis, for installing the vent straddling a ridge of the structure, with the first mentioned ventilation side and first outside-housing portion on one side of the ridge and with the second ventilation side and second outside-housing portion on the other side of the ridge.

The top plate further may include at least one air baffle (14) downstanding therefrom, and at least one support baffle (15) downstanding therefrom. Preferably, the top plate further may include at least one air baffle downstanding therefrom, and a plurality of support baffles downstanding therefrom.

The vent disclosed herein may be supplied in segmented units, which may be aligned side-by-side and connected. For each such unit, the first sidewall and adjoining top plate portion and the second sidewall and adjoining top plate portion may be adapted with complimentary inset and outset portions, to enable two separate such vent units to mate in alignment side-by-side. The top plate may have a first edge (102) overhanging the first sidewall flexion region inset thereunder; it may have an opposite second edge following a stepped-down ledge, defining an outset margin (103) having the second sidewall and flexion region downstanding thereunder and complimentary to the inset. For example, when installing a right-side unit next to an identical left-side unit, each unit will have an inset (or "female") configuration on one side and a complimentary outset (or "male") configuration on the other side. The inset may be formed by the sidewall having a portion converging inwardly beneath the top plate (overhanging, preferably with an edge perpendicular to the ventilation side), prior to merging into the flexion region on that side of the roof ridge. The complimentary outset may be formed on the opposite side (of the other mating unit) by the sidewall having a portion diverging outwardly from the co-planar edge of the top plate (preferably parallel to or complimentary with the opposite edge); there may be a stepped-down ledge extending from the co-planar edge, completing the enclosure. When mated side-by-side, the outset portion inserts or nests within the inset portion of the side wall beneath the overhanging top plate, which overlays the ledge of the adjacent unit.

The vent units may also be shortened for installation, by cutting along a plane perpendicular to the ventilation sides. The top plate may further include at least one support baffle downstanding therefrom near each of the ventilation sides; each of the support baffles may be configured to abut the second sidewall if two separate such vent units are mated in alignment side-by-side after the width of the one vent unit has been shortened by cutting along a plane perpendicular to the ventilation sides.

Besides the vent described herein, the invention includes the method of using the vent. Such method includes the steps of positioning the vent housing portion over the ventilation opening(s) in the roof substratum, with the extension footing positioned in any depressions or other air gaps that may be present in the roof substratum. Then the user compresses the vent against the roof substratum, and anchors the vent to the substratum. Anchoring means may include support baffles having modifications accepting an anchor screw, nail or other fastener; however, any means of anchoring the vent may suffice so long as the obstructing portion or sub-portion is maintained in a position biased downwardly to obstruct any air gap.

Successive units or sections of vent may be aligned side by side across the width of the roof being ventilated. For convenience, the second edge of the top plate (and/or the second sidewall) may be adapted to accept in overlapping engagement an overhanging adaptation portion of the first edge of the top plate, so that adjacent units of vent essentially interlock.

I claim:

1. A vent for a roof or other structure, the vent comprising a cavity housing portion and an extension portion associated therewith:

said cavity housing portion comprising a first sidewall and a second sidewall downstanding from a top plate and at least a first ventilation side downstanding from said top plate;

said extension portion comprising at least a first extension portion;

a plurality of slats extending from a front face of a lower edge of said first ventilation side to an extension footing;

said extension footing extending from between said first sidewall and said second sidewall, and said extension footing further comprising a means of obstructing gaps between said extension footing and the roof or other structure.

2. A vent described in claim 1, said means of obstructing gaps comprising said extension footing having a rigid obstructing portion flexibly biased downwardly below said extension footing.

3. A vent described in claim 2, said rigid obstructing portion comprising a plurality of rigid obstructing sub-portions, each flexibly biased downwardly below said extension footing.

4. A vent described in claim 1, said plurality of slats merging into a corner-edge of said extension footing, said extension footing further comprising a plurality of tabs, each integral with said corner-edge and extending between a respective pair of said slats, each of said tabs flexibly biased downwardly below said extension footing.

5. A vent described in claim 4, the plurality of said tabs comprising a free edge opposite said corner-edge and forming a flange angularly downstanding below said extension footing.

6. A vent described in claim 4, said corner-edge merging into a wind deflector face upstanding therefrom.

7. A vent described in claim 4, said corner-edge further defining at least one drainage opening.

8. A vent described in claim 1, said corner-edge comprising a plurality of ventilation openings.

9. A vent described in claim 1, said first sidewall and second sidewall, each of said sidewalls having a flexion region, said cavity housing portion further comprising a second ventilation side opposite said first ventilation side and a second extension portion opposite said first extension portion, said flexion regions allowing the bending of said vent for installing said vent straddling a ridge of the roof or other structure, with the first ventilation side and the first extension portion positioned on a first side of the ridge and the second ventilation side and the second extension portion positioned on a second side of the ridge.

10. A vent described in claim 9, said first sidewall and adjoining top plate portion and said second sidewall and adjoining top plate portion, respectively adapted with complimentary inset and outset portions to enable a first vent and a second vent to mate in alignment side-by-side.

11. A vent described in claim 10, said top plate having a first edge portion overhanging said first flexion region inset thereunder said top plate having a second edge portion opposite said first edge portion, said second edge portion following a stepped-down ledge defining an outset margin, said second edge portion having said second sidewall and said second flexion region downstanding thereunder and complimentary to said inset.

12. A vent described in claim 11, said top plate further comprising at least one support baffle downstanding therefrom near each of said ventilation sides, each of said support baffles configured to abut said second sidewall when the first vent and the second vent are mated in alignment side-by-side after the width of one of the first vent or second vent has been shortened.

13. A vent for a roof or other structure, the vent comprising a cavity housing portion and a first extension portion associated therewith:

(a) said cavity housing portion comprising:

1) a top plate having a first edge, a second edge and a ventilation edge, 2) a first sidewall downstanding from said first edge;

3) a second sidewall downstanding from said second edge; and 4) a ventilation side downstanding from said ventilation edge and including a lower edge opposite thereto; and (b) said first extension portion comprising:

1) a plurality of slats extending from a front face of a lower edge of said ventilation side to an extension footing;

2) said extension footing extending from between said first sidewall and said second sidewall; and 3) a means of obstructing gaps between said extension footing and the roof or other structure, said means of obstructing gaps comprising said extension footing comprising at least one rigid obstructing portion biased downwardly below said extension footing.

14. A vent described in claim 13, said rigid obstructing portion comprising a plurality of rigid obstructing sub-portions, each flexibly biased downwardly below said extension footing.

15. A vent described in claim 14, said plurality of slats merge into a corner-edge of said extension footing, said rigid obstructing sub-portions further comprising a plurality of tabs, each integral with said corner-edge and extending between a respective pair of said slats, each of said tabs comprising a free edge opposite said corner-edge and forming a flange angularly downstanding and flexibly biased below said extension footing.

16. A vent described in claim 15, said extension footing corner-edge merging into a wind deflector face upstanding therefrom, said corner-edge further defining a plurality of drainage openings.

17. A vent described in claim 13, wherein said ventilation side is a first ventilation side and said ventilation edge is a first ventilation edge, each of said sidewalls having a flexion region, said cavity housing portion further comprising a second ventilation side opposite said first ventilation side and a second extension portion opposite said first extension portion, said flexion regions allowing the bending of said vent for installing said vent straddling a ridge of the roof or other structure, with the first ventilation side and first extension portion on a first side of the ridge and with the second ventilation side and second extension portion on a second side of the ridge.

18. A vent described in claim 13, said top plate further comprising at least one air baffle downstanding therefrom, and at least one support baffle downstanding therefrom.

19. A vent described in claim 13, said top plate further comprising at least one air baffle downstanding therefrom, and a plurality of support baffles downstanding therefrom.

* * * * *